US011622668B2

(12) United States Patent
Onodi

(10) Patent No.: US 11,622,668 B2
(45) Date of Patent: Apr. 11, 2023

(54) KIT WITH ELECTRICALLY ENERGIZED ROTARY BRUSH FOR CLEANING SHOE SOLES

(71) Applicant: SOLEMATE GOLF LLC, Melvindale, MI (US)

(72) Inventor: Sandor J. Onodi, Rockwood, MI (US)

(73) Assignee: SOLEMATE GOLF LLC, Melvindale, MI (US)

( * ) Notice: Subject to any disclaimer, the term of this patent is extended or adjusted under 35 U.S.C. 154(b) by 478 days.

(21) Appl. No.: 16/749,644

(22) Filed: Jan. 22, 2020

(65) Prior Publication Data

US 2021/0219815 A1 Jul. 22, 2021

(51) Int. Cl.

| | |
|---|---|
| ***A47L 23/00*** | (2006.01) |
| ***A47L 23/06*** | (2006.01) |
| ***A46B 9/06*** | (2006.01) |
| ***A46B 13/00*** | (2006.01) |
| ***A46B 13/02*** | (2006.01) |
| ***A46D 1/00*** | (2006.01) |
| ***B08B 1/00*** | (2006.01) |
| ***A47L 23/02*** | (2006.01) |
| ***A46B 17/08*** | (2006.01) |

(52) U.S. Cl.

CPC ..... *A47L 23/06* (2013.01); *A46B 9/06* (2013.01); *A46B 13/003* (2013.01); *A46B 13/02* (2013.01); *A46B 17/08* (2013.01); *A46D 1/0207* (2013.01); *A47L 23/02* (2013.01); *B08B 1/002* (2013.01); *A46B 2200/306* (2013.01)

(58) Field of Classification Search

CPC ..... A47L 23/00; A47L 23/06; A46B 13/02

See application file for complete search history.

(56) References Cited

U.S. PATENT DOCUMENTS

| | | | | |
|---|---|---|---|---|
| 2,934,775 | A * | 5/1960 | Bergstrom | A47L 23/06 401/268 |
| 3,251,085 | A * | 5/1966 | Jacobs | A47L 23/06 15/23 |
| 5,533,843 | A * | 7/1996 | Chung | B25H 3/006 206/349 |
| 8,984,695 | B2 * | 3/2015 | Manning | A47L 13/38 15/23 |
| 9,456,682 | B2 * | 10/2016 | Taylor | A46B 13/02 |
| 10,112,219 | B1 * | 10/2018 | McManaman | B08B 1/04 |
| 10,314,388 | B2 * | 6/2019 | Rivera | A46B 13/001 |
| 10,624,447 | B1 * | 4/2020 | Manning | A46B 13/001 |
| 2002/0174499 | A1 * | 11/2002 | Meshbesher | A47L 23/22 15/112 |

(Continued)

*Primary Examiner* — Michael D Jennings

(74) *Attorney, Agent, or Firm* — Mitchell Law PLLC; Matthew W. Mitchell

(57) ABSTRACT

A kit for cleaning an object such as the soles of shoes having debris accumulated during use. The kit includes a carrying case that accommodates a cleaning tool. A hand-held means for generating rotational movement is adapted to spin a shaft about a driving axis. At a distal end of the shaft there is an assembly of bristles that are adapted to rotate with the shaft. The bristles engage the sole of a shoe. The bristles preferably include Nylon® or a polyester. They are flexible and tend to sweep away debris from between for example golf shoe cleats, rather than scratch or abrade the soles of the golf shoes.

16 Claims, 3 Drawing Sheets

(56) References Cited

U.S. PATENT DOCUMENTS

| | | | | |
|---|---|---|---|---|
| 2013/0091646 | A1* | 4/2013 | Bennett | A47L 23/06<br>15/97.2 |
| 2019/0191937 | A1* | 6/2019 | Straka | A47K 7/043 |
| 2021/0085067 | A1* | 3/2021 | Pasch | A46B 13/02 |

* cited by examiner

KIT WITH ELECTRICALLY ENERGIZED ROTARY BRUSH FOR CLEANING SHOE SOLES

TECHNICAL FIELD

Several aspects of this disclosure relate to a kit with an electrically energized rotary brush for cleaning debris from the soles of footwear. Most specifically, certain aspects of this disclosure deal with using components of the kit to free debris from cleats found in the soles of golf shoes.

BACKGROUND

The outdoor sports enthusiast is familiar with problems that relate to the accumulation of debris on the underside of his or her footwear. One example lies in the game of golf. Participants in that sport play a game under varied conditions. The likelihood of acquiring an accumulation of grass and soil on cleats which are secured to the underside of a typical golf shoe is sometimes inconvenient. Further, such accumulations may exist even under favorable playing conditions.

The golfer and sports enthusiast are often frustrated by the dirt and debris that accumulate on the bottom sole surface of shoes worn for the activity. If one were to rely on the use of ground-mounted cleaning brushes at the entry or exit points of a golf course clubhouse, often those brushes are broken or worn to the point of being ineffective. Such equipment usually does not comfortably and efficiently clean the bottom surface and soles of shoes.

Use of such ground-mounted equipment requires the user to walk or to where the equipment is installed, and operate the equipment in a standing position. It would be desirable to have a portable solution that can be operated in a decentralized location (e.g., a parking lot) where there are fewer users waiting their turn to use the equipment.

A substantial number of golfers have found this to be a major issue. Accordingly, they may proceed to the parking lot and start banging and rubbing their golf shoes together in an effort to remove accumulated debris from shoe soles. The general composition of this debris includes grass, leaves, mud, sand and goose droppings.

Other known techniques for cleaning golf shoes include deployment of a hand-held brush or towel. However, such approaches are typically suboptimal in removing debris from the interstices of cleats in a golf shoe.

Other conventional cleaning approaches include a direct current-powered golf club cleaning device, such as that disclosed in U.S. Pat. No. 5,235,716. It is powered by a battery-operated motor that is located inside a housing which has a shaft extending from the front of the motor and through the housing. Id, Abstract. The cleaning head includes radially extending bristles. Id, col. 3, ll. 41-43.

SUMMARY

In response to such needs and desires, various aspects of this disclosure have been developed. Several embodiments relate to a kit for cleaning the soles of shoes having debris accumulated during use.

The kit includes a carrying case that accommodates a cleaning tool.

A hand-held means for generating rotational movement is adapted to spin a shaft about a driving axis. At a distal end of the shaft there is an assembly of bristles that are adapted to rotate with the shaft. The bristles engage the sole of a shoe.

The bristles preferably include Nylon® or a polyester. Such bristles are benign in that they are flexible and tend to sweep away debris from between for example golf shoe cleats rather than scratch or abrade the soles of the golf shoes.

In some respects, the disclosed kit includes a battery-operated motor that in several embodiments has variable high and low speeds together with a forward or reverse rotational direction. Preferably, the motor is energized by a rechargeable lithium ion battery. Connected to the motor is a rotary brush that includes coarse non-metallic bristles and preferably has a cup-like shape.

One result is the convenient and thorough cleaning of spiked and uneven surfaces of shoe soles.

In some applications, the disclosed kit can be used to clean the head of golf clubs without inflicting damage.

It will be appreciated that the disclosed kit can also be used clean virtually any other uneven, spiked and non-spiked shoes, or any type of footwear.

DETAILED DESCRIPTION

As required, detailed embodiments of the present invention are disclosed herein; however, it is to be understood that the disclosed embodiments are merely exemplary of the invention that may be embodied in various and alternative forms. The Figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
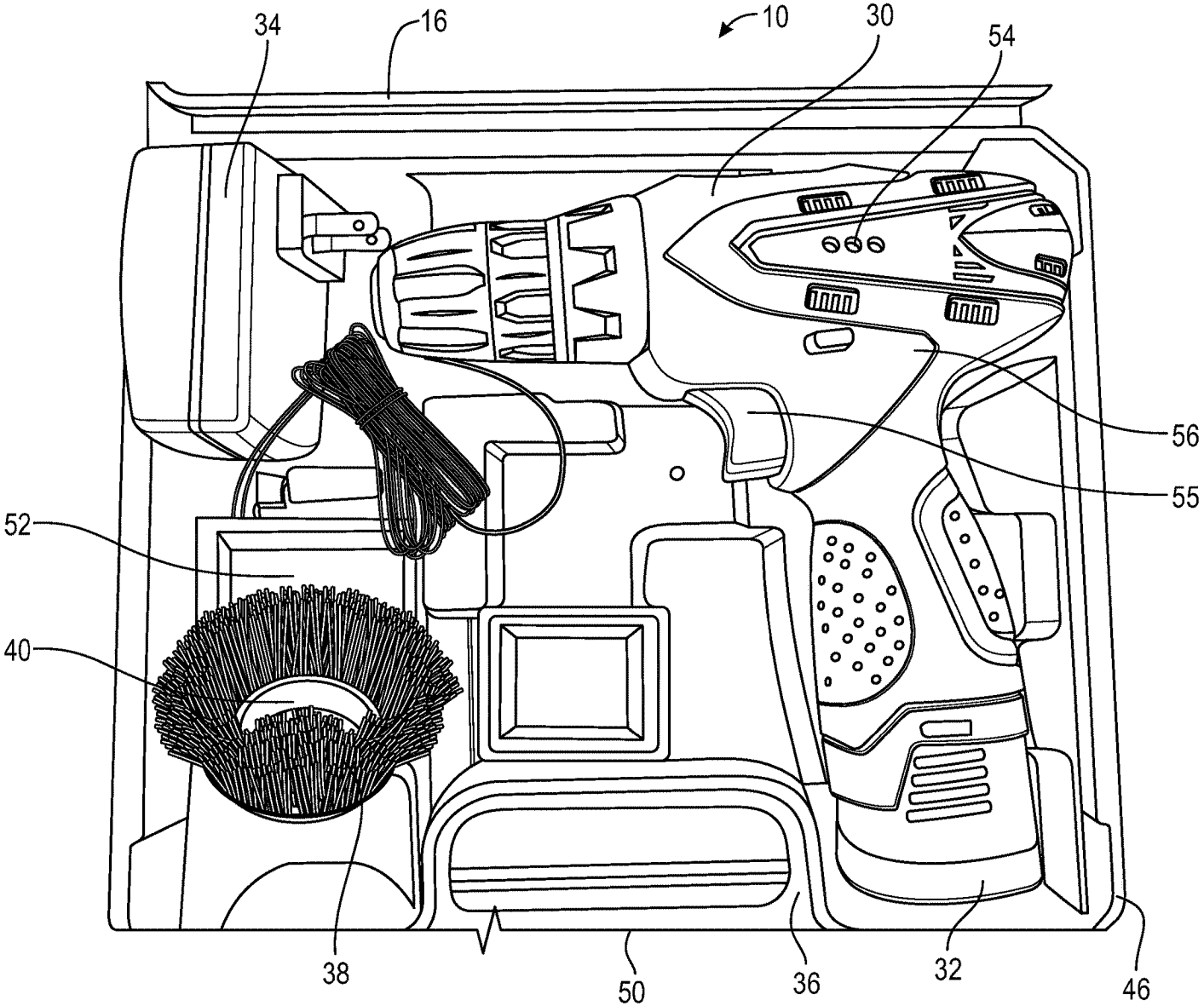
FIG. 1 is a top plan view of a kit including a case for accommodating cleaning components according to one embodiment of this disclosure.
Figure 2:
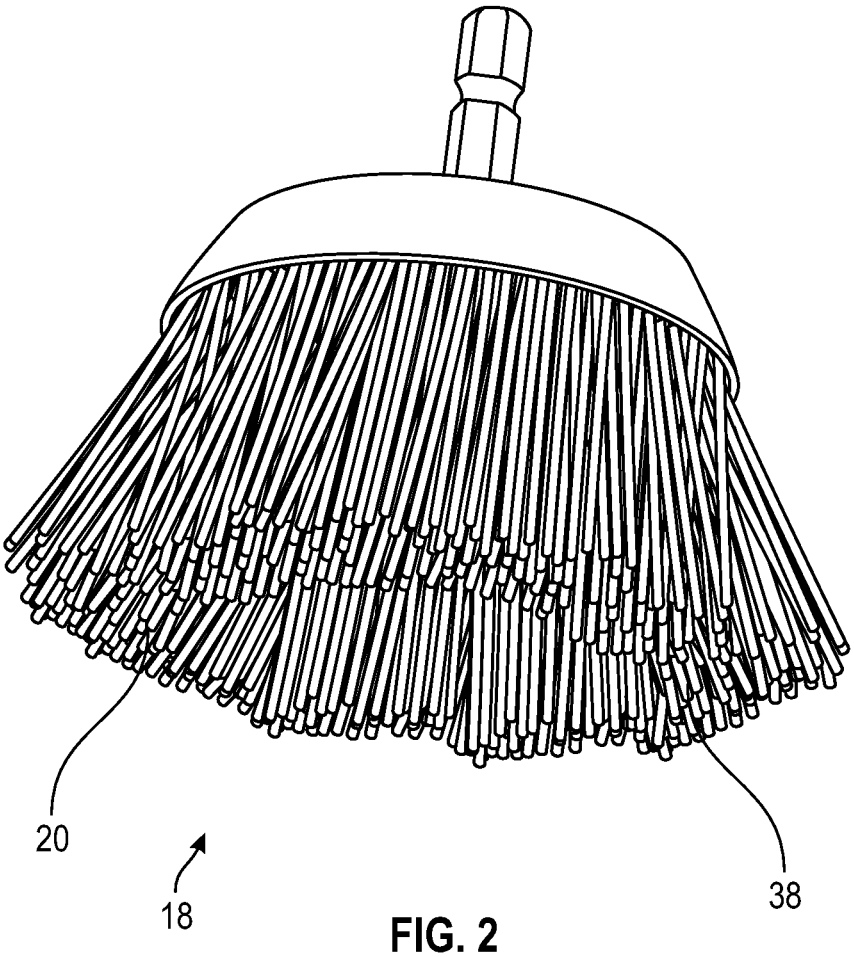
FIG. 2 is a perspective view of a rotary bristle assembly.
Figure 3:
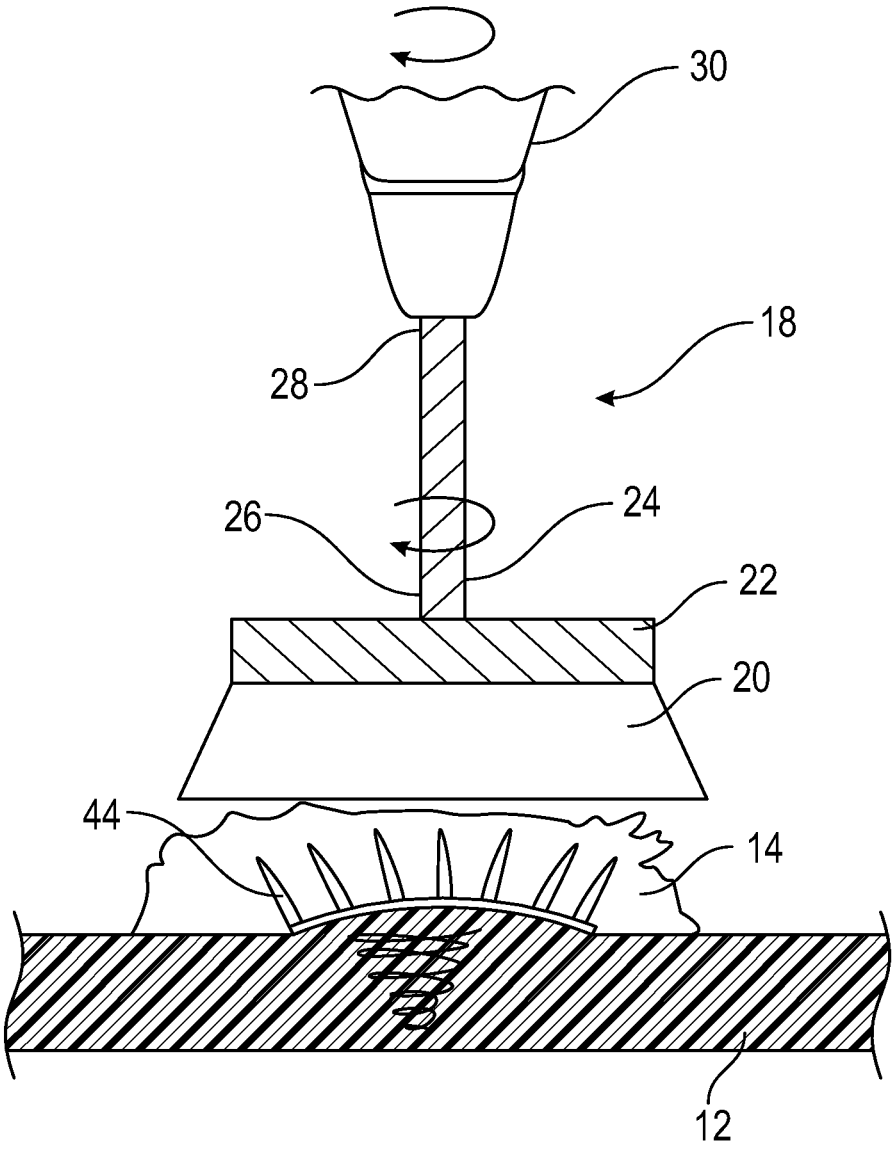
FIG. 3 is a side view of the rotary bristle assembly upon engagement with debris that lies across and between for example cleats that are mounted in the sole of a golf shoe.

In several respects, this disclosure includes a kit 10 (FIGS. 1-3) for cleaning the soles 12 of shoes with debris 14 accumulated during use. One representative application lies in the cleaning of mud, turf and other debris that is ensnared by the cleats 44 which are on the underside of a golf shoe sole.

In one embodiment (FIG. 1), the kit includes a carrying case 16 that usually has a handle 50. Inside the case is a cleaning tool 18 that is adapted to spin. The cleaning tool is mounted on a shaft 24 that extends from and spins under the influence of a hand-held electrical means for generating rotational movement 30, such as a battery which may be rechargable.

One embodiment of the cleaning tool has an assembly of bristles 20 (FIGS. 2-3) that collectively rotate with the shaft while engaging the sole of a shoe.

A holder 22 is affixed to the shaft and secures the bristles in relation to the shaft. Thus, the assembly of bristles rotates as the shaft spins under the influence of the electrical means for generating rotational movement.

The shaft has a distal end portion 26 that unites with the holder and a proximal end 28 that is secured by a chuck associated with the electrical means for generating rotational movement.

Inside the kit is a source of electrical energy 32 with which to power the hand-held means for generating rotational movement. The source of electrical energy is preferably a battery that optionally may be charged by an external power supply. To charge the battery, the kit includes an A/C adaptor 34 and a power chord that communicates with a source of external electrical power. Optionally a spare battery may be included in the kit.

In some embodiments the hand-held electrical means for generating rotational movement 30 (FIG. 1) includes a gage 54 for displaying battery strength level.

It will be appreciated that the kit has uses that extend beyond the cleaning of debris from a golf shoe. Such uses include the cleaning of shoes and equipment used in such fields as lawn tennis, lacrosse, hockey, gardening and hunting. Such shoes may have cleats that support the debris to be removed from the shoe sole.

The cleaning tool has bristles that are sufficiently flexible to bend in response to rotary forces and linear forces that are applied when the cleaning tool is brought into engagement with the shoe sole. Such forces include circumferentially-directed forces imparted as the bristles rotate and axially-directed forces imparted as the bristles are pushed into engagement with the surface to be cleaned.

Preferably, at least some of the bristles 38 include Nylon® or polyester. As used herein, the term Nylon® is a generic designation for a family of synthetic polymers, based on aliphatic or semi-aromatic polyamides. en.wikipedia.org/wiki/Nylon. In some embodiments, Nylon® is a thermoplastic material that can be melt-processed into fibers. Id. Nylon polymers can be mixed with a wide variety of additives to achieve many different property variations. Id. Nylon polymers have found significant commercial applications in fibers.

Before engagement with the shoe sole, the bristles in the assembly are oriented substantially in parallel to an axis of shaft rotation. In some cases, at least some of the bristles are filled with an abrasive material. In use, some of the abrasive particles or fluid are dissipated during cleaning, only to be replaced by other abrasives in the assembly of bristles.

One representative assembly of abrasive-filled bristles is found in Scotch-Brite™ made by 3M. Such bristles may have the characteristics of being able to clean and remove debris more effectively with less pressure than wire brushes and conform to contours of the surface to be cleaned. Further, such bristles contain no wire filaments, which may provide improved safety to the user. It is thought that such bristles remain safely in place after prolonged use and may last longer than wire brushes.

The assembly of bristles is secured by the holder in a circular array with a peripheral region of bristles 38 that engages the shoe sole and a central region 40 that receives the holder and the distal end of the shaft. The peripheral region includes concentric circular rows of bristles. Preferably, the number of concentric circular rows lies between 2 and 10. The central region of the holder includes a buffer that serves as a depth gauge which limits forward movement of the distal end of the shaft in relation to the shoe sole.

Individual bristles bend when the assembly of bristles rotatably engages the shoe sole. In use, the bristles in contact with the shoe sole or cleat and sweep away the debris substantially non abrasively, thereby leaving the shoe sole unmarked.

Preferably, the carrying case 48 has a base, a lid and a locking mechanism that secures the base and lid together. Optionally, the base includes shaped recesses 52 that accommodate components of the kit.

It will be appreciated that the electrical means for generating rotational movement may be provided with such accessory features as a trigger switch, a forward/reverse/speed control button(s), a work light, a chuck, a torque adjustment collar, a battery indicator light and a release button.

TABLE OF

REFERENCE NUMBERS

| Reference No. | Component |
|---|---|
| 10 | Kit |
| 12 | Sole |
| 14 | Debris |
| 16 | Carrying case |
| 18 | Cleaning tool |
| 20 | Bristles |
| 22 | Holder |
| 24 | Shaft |
| 26 | Distal end |
| 28 | Proximal end |
| 30 | Means for generating rotational movement |
| 32 | Source of electrical energy |
| 34 | A/C adaptor |
| 38 | Bristles |
| 40 | Central region |
| 44 | Cleats |
| 50 | Handle |
| 52 | Shaped recesses |
| 54 | Battery strength gage |

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A kit for cleaning objects with debris accumulated during use, the kit including:

a carrying case;

a golf shoe having a sole and cleats;

a cleaning tool that is adapted to rotate, the tool having an assembly of bristles configured to engage the sole of the shoe;

a holder that secures the bristles; and a shaft that supports the holder, the shaft having a distal end portion that unites with the holder and a proximal end; and a hand-held means for generating rotational movement that is adapted to drive the proximal end of the shaft.

2. The kit of claim 1, further including a source of electrical energy with which to power the hand-held means for generating rotational movement.

3. The kit of claim 2, wherein the source of electrical energy is selected from the group consisting of a battery and an external power supply.

4. The kit of claim 1, wherein the cleaning tool includes a rotating bristle brush with the assembly of bristles being sufficiently flexible to bend in response to rotary forces and linear forces that are applied when the cleaning tool is brought into engagement with the shoe sole.

5. The kit of claim 4, wherein at least some of the bristles are formed of a synthetic polymer.

6. The kit of claim 5, wherein the bristles before engagement with the shoe sole are oriented substantially in parallel to an axis of shaft rotation.

7. The kit of claim 6, wherein at least some of the bristles are abrasive-filled.

8. The kit of claim 1, further including an adaptor and power chord for energizing the means for generating rotational movement by a source of electrical power.

9. The kit of claim 1, wherein the carrying case has a handle to facilitate portability of the kit.

10. The kit of claim 1, wherein the assembly of bristles is secured by the holder in a circular array with a peripheral region that engages a shoe sole and a central region that receives the holder.

11. The kit of claim 10, wherein the bristles bend when the assembly of bristles rotatably engages the shoe sole and sweeps away the debris substantially non abrasively, thereby leaving the shoe sole unmarked.

12. The kit of claim 10, wherein the holder includes a central region with a buffer that serves as a depth gauge that limits forward movement of the distal end of the shaft in relation to the shoe sole.

13. The kit of claim 10, wherein the peripheral region includes concentric circular rows of bristles.

14. The kit of claim 13, wherein a number of concentric circular rows of bristles in the assembly of bristles lies between 2 and 10.

15. The kit of claim 1, wherein the carrying case has a base, a lid and a locking mechanism that secures the base and lid together, the base and the lid including shaped recesses that accommodate components of the kit.

16. The kit of claim 1, wherein the hand-held electrical means for generating rotational movement includes a battery strength level gage.

* * * * *